US006385911B1

(12) United States Patent
Anderson et al.

(10) Patent No.: US 6,385,911 B1
(45) **Date of Patent: *May 14, 2002**

(54) WINDOW OPERATOR

(75) Inventors: Todd A. Anderson, Albert Lea; Douglas G. Johnson, Blooming Prairie; James G. Seaser, Owatonna; Sabrina Tucker, Waseca, all of MN (US)

(73) Assignee: Truth Hardware, Otwatonna, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/021,607

(22) Filed: Feb. 10, 1998

Related U.S. Application Data

(63) Continuation of application No. 08/575,143, filed on Dec. 19, 1995, now Pat. No. 5,765,308.

(51) Int. Cl.[7] ..... E05F 11/24
(52) U.S. Cl. ..... 49/342; 49/343
(58) Field of Search ..... 49/339, 341, 342, 49/343, 348, 349; 74/89.18

(56) References Cited

U.S. PATENT DOCUMENTS

| | | | | |
|---|---|---|---|---|
| 2,050,403 A | | 8/1936 | Weiner | |
| 2,082,066 A | | 6/1937 | Lackey | |
| 2,214,280 A | | 9/1940 | Lang | |
| 2,321,800 A | | 6/1943 | Cordrey et al. | |
| 2,610,054 A | | 9/1952 | Reynaud | |
| 2,635,485 A | | 4/1953 | Gravenstine et al. | |
| 2,795,413 A | | 6/1957 | Rodaway | |
| 2,899,195 A | | 8/1959 | Ahlgren | |
| 2,926,905 A | | 3/1960 | Ahlgren | |
| 3,114,542 A | | 12/1963 | Ahlgren | |
| 3,846,938 A | | 11/1974 | Kelly | 49/342 |
| 4,253,276 A | | 3/1981 | Peterson et al. | 49/249 |
| 4,505,601 A | * | 3/1985 | Sandberg et al. | 384/428 |
| 4,823,508 A | | 4/1989 | Allen | 49/252 |
| 4,860,493 A | | 8/1989 | Lense | 49/279 |
| 5,623,784 A | | 4/1997 | Knersten | 49/342 |
| 5,765,308 A | | 6/1998 | Anderson | 11/24 |
| 5,802,913 A | * | 9/1998 | Winner | 74/89.18 |
| 5,839,229 A | * | 11/1998 | Briggs et al. | 149/246 |

FOREIGN PATENT DOCUMENTS

| | | |
|---|---|---|
| CA | 50505/61 | 1/1992 |
| CA | 2079682 | 8/1992 |
| WO | WO92/14019 | 8/1992 |
| WO | WO95/18284 | 7/1995 |

OTHER PUBLICATIONS

Roto Architectural Hardware brochure, Feb., 1991.

* cited by examiner

*Primary Examiner*—Curtis A. Cohen
(74) *Attorney, Agent, or Firm*—Lorusso & Loud

(57) ABSTRACT

An operator for controlling the movement of a window sash relative to a frame with a raised surface along a frame sill thereof, wherein the operator includes a base having a first support surface, an aperture and a bottom exterior surface with a slot therein, the base attached to the frame with the raised surface fitting substantially within the slot. The operator also includes a cover secured to the base and having a second support surface with a hole therethrough defining an internal shoulder, the second support surface mating with the first support surface. A post extends from the cover and through the aperture in the base when the operator is assembled. An arm is pivotally secured to the post and attachable to the sash to control the movement of the sash between open and closed positions. A worm drivably engages the arm and has a worm shaft and a worm shoulder disposed on the worm shaft. The worm is directly supported by the first and second surfaces at one end and the worm shoulder engages the internal shoulder as the worm shaft protruding from the hole.

9 Claims, 6 Drawing Sheets

WINDOW OPERATOR

CROSS REFERENCE TO RELATED APPLICATION

This is a continuation application of U.S. Ser. No. 08/575,143, filed Dec. 19, 1995 now U.S. Pat. No. 5,765,308.

BACKGROUND OF THE INVENTION

1. TECHNICAL FIELD

The present invention is directed toward window operators, and more particularly toward window operators wherein the operating mechanism is supported directly by the cover and the base. The present invention is also directed toward window operators having reduced air/water infiltration.

2. BACKGROUND ART

Windows are commonly constructed having a frame and a sash. The sash is pivotally secured to the frame for motion between a closed position, wherein the sash fits substantially within the frame, and an open position, wherein the sash is rotated relative to the frame so that the sash is not substantially within the frame.

Window operators used to control the movement of the sash between the open and closed positions are well known in the art. A window operator typically has a mounting base with a flat planar bottom secured to a corresponding flat planar surface on a sill of the frame. The mounting base rotatably mounts a gear or gear train and an arm. The gear or gear train meshes with a worm on a worm shaft having either a manually operated handle or motorized controller attached thereto. The arm is operatively connected to the sash of the window whereby rotation of the worm shaft results in rotation of the gear or gear train and the arm for movement of the window between the open and closed positions. Examples of typical manually operated window operators can be found in U.S. Pat. Nos. 4,253,276, 4,266,371, 4,445,794 and 4,845,830.

As illustrated in greater detail in U.S. Pat. Nos. 4,445,794 and 4,845,830, window operators are typically manufactured with the worm mounted in an upwardly angled generally tubular housing integrally formed in the base. Through an aperture in the housing, the worm meshes with the gear or, alternatively, the gear train. The gear is operably associated with the arm such that rotation of the worm results in rotation of the gear and associated arm about a fixed pivot pin.

To secure the worm in place in the tubular housing, a retainer bearing is threaded into position at an open end of the housing. The threaded retainer bearing, as shown in U.S. Pat. No. 4,253,276, may be held in place by use of an additional structural element, such as a locking pin, wedged between the threads of the bearing and the housing. Use of the locking pin may be avoided through the use of a specially shaped retainer bearing and limited deformation of the housing, such as shown in U.S. Pat. No. 4,505,601. Yet another alternative locking arrangement is shown in U.S. Pat. No. 4,445,794, wherein the retainer bearing locks the worm in place by stripping the threads at the open end of the housing as the retainer bearing is advanced into the housing To install the assembled operator to the window, the flat planar bottom surface of the operator is placed against the flat planar bottom surface of a window frame sill. A gasket may be placed around the rear of the operator and between the operator and the sill. The base is then secured against the sill through the use of fasteners, such as screws, disposed through apertures in the base.

The above window operators are hard to make, and are consequently expensive to make. Cores or paddles must be used to shape the tubular housing.

Moreover, additional manufacturing steps must be performed and additional costs must be incurred because a separate, threaded retainer bearing is required to hold the worm in the tubular housing. Use of a separate retainer bearing increases the part count and the complexity of the assembly process. Furthermore, because a threaded retainer bearing is commonly used, additional preparatory machining steps must be performed on the tubular housing prior to assembly. Costs may be increased even further if an advanced locking mechanism, such as that shown in U.S. Pat. No. 4,505,601, is used because of the sophistication of the retainer bearing used and the assembly steps required.

Additionally, by securing the arm to the base using a simple pin, the operator is sensitive to variations in the tolerance of the constituent pieces and in the manufacturing processes. Therefore, in order to control the sensitivity of the device, as expressed in the gear arm backlash, tolerances and processes must be kept within narrowly defined limits. By restricting the range of allowable tolerances and processes, however, the cost per operator is necessarily increased.

Furthermore, the design of the above operators allows for air and water to infiltrate through the operator. Use of a retainer bearing normally prevents the operator from being assembled with a seal which acts to prevent substantial air flow through the worm housing opening. Additionally, air and/or water may infiltrate around the rear of the operator and between the bottom of the base and the flat planar surface of the window frame sill.

Attempts have been made in the industry to address some of these problems. For example, an operator has been designed which uses a conventional tubular worm housing, similar to that shown in U.S. Pat. No. 4,266,371, but in combination with an arm which is secured between mating interior surfaces of the cover and the base. In particular, a central post depends from an interior surface of the cover through an aperture in the base. The arm having a gear and a bearing associated therewith is pivotally mounted on the central post. The arm is secured in place by passing the central post through the aperture, and then riveting the post in place.

Additionally, this operator has a rearwardly protruding edge integral with the base disposed around the rearwardly facing surface of the base. A gasket may be placed around the rearwardly protruding edge to limit the infiltration of water and air around the operator.

However, this operator still presents all of the problems outlined above when a conventional worm housing integral with the base is used. Additionally, this operator fails to address the problem of infiltration of air and/or water at the base/sill interface.

The present invention is directed toward overcoming one or more of the problems discussed above.

SUMMARY OF THE INVENTION

In one aspect of the invention, an operator for controlling the movement of a window sash relative to a frame between open and closed positions includes a base attachable to the frame and having a first support surface, and a cover secured to the base and having a second support surface with a hole therethrough defining an internal shoulder, the second support surface mating with the first support surface. An arm is pivotally secured to the base and attachable to the sash to control the movement of the sash between open and closed positions. A worm drivably engages the arm. The worm has a worm shaft and a worm shoulder disposed on the worm shaft. The worm is directly supported by the first and second surfaces at one end and the worm shoulder engages the internal shoulder as the worm shaft protruding from the hole.

In another aspect of the invention, an operator for controlling the movement of a window sash relative to a frame between open and closed positions comprises a base attachable to the frame and having a first support surface and an aperture, and a cover secured to the base and having a second support surface with a hole therethrough defining an internal shoulder, the second support surface mating with the first support surface. A post extends from the cover and through the aperture. An arm is pivotally secured to the post and attachable to the sash to control the movement of the sash between open and closed positions. A worm drivably engages the arm and includes a worm shaft and a worm shoulder disposed on the worm shaft. The worm is directly supported by the first and second surfaces at one end and the worm shoulder engages the internal shoulder with the worm shaft protruding from the hole.

In an additional aspect of the invention, a method of manufacturing a window operator is provided wherein the operator includes a base attachable to a frame and having a first support surface and a plurality of apertures, a cover secured to the base and having a second support surface with a hole therethrough defining an internal shoulder, the second support surface mating with the first support surface, a central post and a plurality of fastener posts extending from the cover and through the plurality of apertures, an arm pivotally secured to the central post and attachable to a sash to control the movement of a sash between open and closed positions, and a worm drivably engaging said arm and having a worm shaft and a worm shoulder disposed on the worm shaft, said worm directly supported by the first and second surfaces at one end and the worm shoulder engaging the internal shoulder with the worm shaft protruding from the hole. The method includes the steps of passing the worm shaft through the hole with the worm shoulder engaging the internal shoulder and the worm disposed against the first support surface, fitting the arm to the central post, the arm in drivable engagement with the worm, placing the base and the cover together with the worm disposed between the first and second support surfaces and the central post and plurality of fastener posts protruding through the plurality of apertures, forming the central post, controlling the time and force applied in said central post forming step to eliminate the axial play along the central post, and securing said plurality of fastener posts.

In a further aspect of the invention, an operator for use with a window having a frame with a raised surface protruding from a frame sill and a sash moveable relative to the frame between open and closed positions includes a base having an interior support surface and a bottom exterior surface with a slot therein, the base attached to the frame with the raised surface fitting substantially within the slot. An arm is pivotally secured to the base and attachable to the sash to control the movement of the sash between open and closed positions. A worm is disposed within the interior support surface and drivably engages the arm.

In another aspect of the invention, an operator for use with a window having a frame with a raised surface protruding from a frame sill and a sash moveable relative to the frame between open and closed positions includes a base having a first support surface and a bottom exterior surface with a slot therein, the base attached to the frame with the raised surface fitting substantially within the slot, and a cover secured to the base and having a second support surface with a hole therethrough defining an internal shoulder, the second support surface mating with the first support surface. An arm is pivotally secured to the base and attachable to the sash to control the movement of the sash between open and closed positions. A worm drivably engages the arm and has a worm shaft and a worm shoulder disposed on the worm shaft. The worm is directly supported by the first and second surfaces at one end and the worm shoulder engages the internal shoulder with the worm shaft protruding from the hole.

It is an object of the invention to provide a window operator using parts which are easier and less expensive to manufacture and assemble.

It is a further object of the invention to provide a window operator which is less sensitive to tolerance or assembly process variations.

It is also an object of the invention to provide a window operator which prevents substantial air and water infiltration therethrough.

It is additionally an object of the invention to provide a window operator system with a complete sealing surface at the system/window interface which prevents substantial air and water infiltration therethrough.

DESCRIPTION OF THE PREFERRED EMBODIMENT

Figure 1:
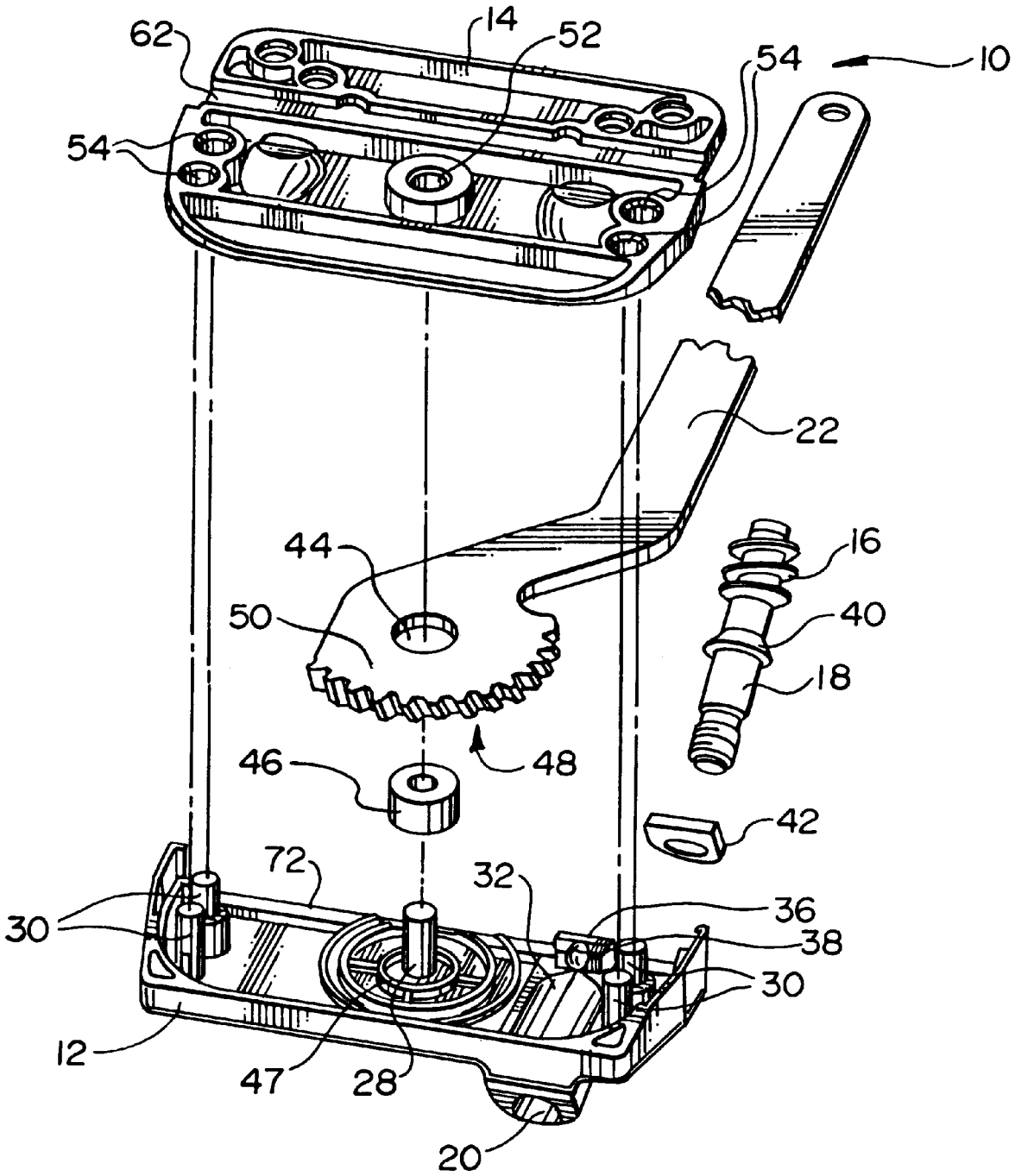
FIG. 1 is an exploded perspective view of an exemplary embodiment of the present invention.
Figure 6:
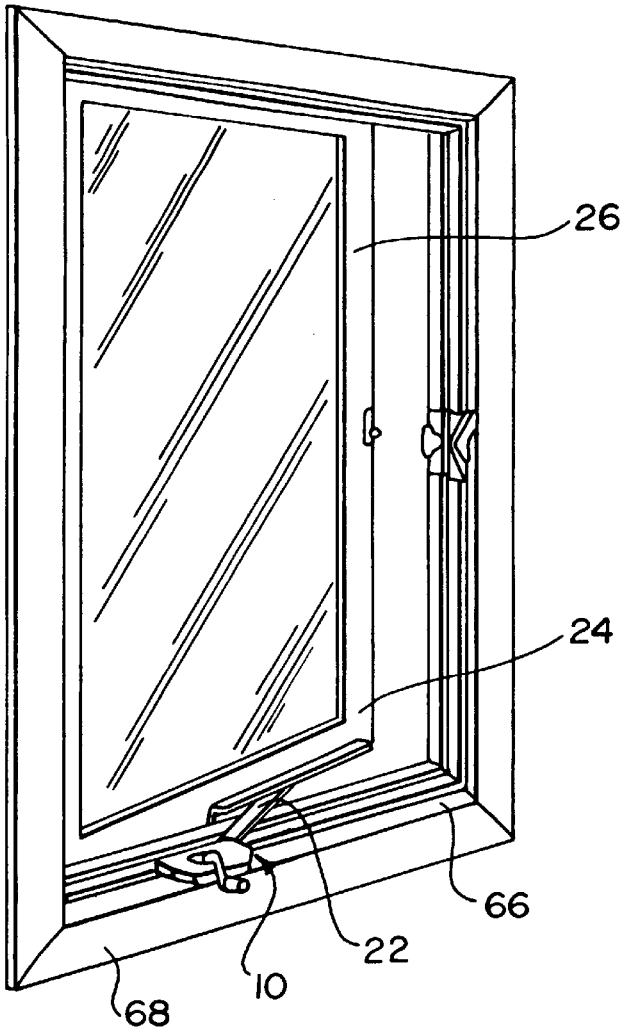
FIG. 6 is a perspective view of an exemplary embodiment of the present invention installed to a window having a frame and a sash.

An exemplary embodiment of the present invention is shown generally at 10 in FIG. 1. A cover 12 is attached to a base 14. Disposed between mating surfaces of the cover 12 and the base 14 is a worm 16 having a worm shaft 18 extending through an aperture 20 in the cover 12. An arm 22 is also pivotally secured between the cover 12 and the base 14. The arm 22 is drivably engaged by the worm 16 at one end and is capable of being secured to a rail 24 of a sash 26 at the other (see FIG. 6).

Figure 2:
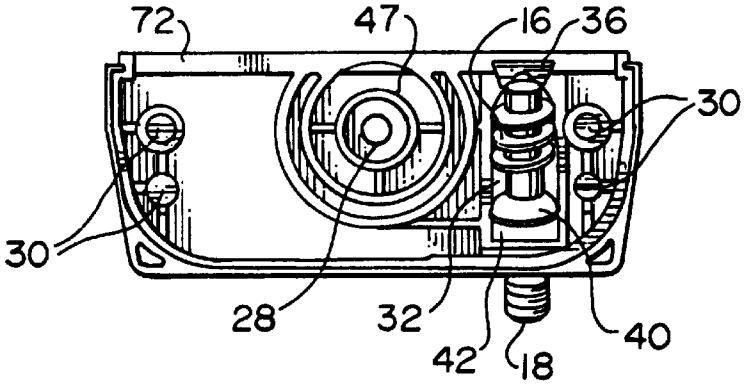
FIG. 2 is a bottom plan view of a cover according to an exemplary embodiment of the present invention with a worm disposed in a support surface.
Figure 5:
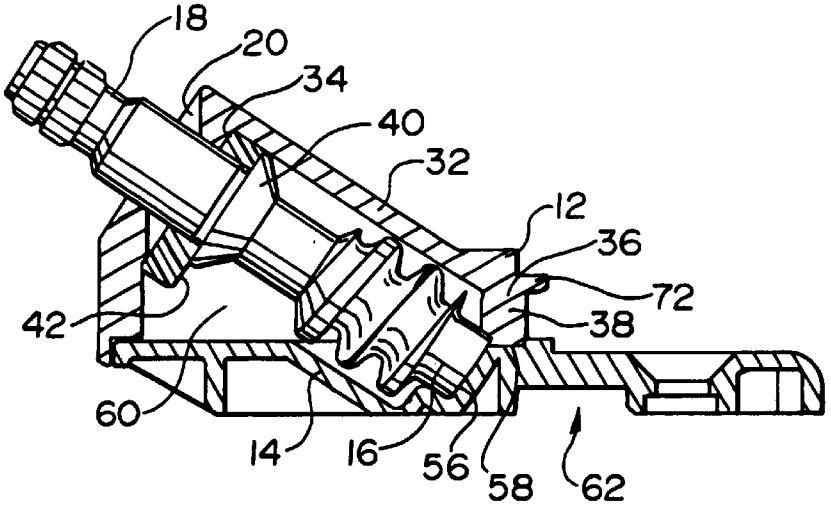
FIG. 5 is a cross-sectional view taken along line 5—5 in FIG. 4.

More specifically, referring to FIGS. 1, 2 and 5, the cover 12, preferably of a zinc die cast manufacture, has a central tapered cylindrical post 28 and four tapered cylindrical fastener posts 30 protruding outwardly from an interior side of the cover 12. The fastener posts 30 are spaced to roughly coincide with the four corners of the cover 12.

The cover 12 also has an angled tubular surface 32. At one end of the tubular surface 32 is the aperture 20. The aperture 20 is formed as the intersection of a circular cylinder and an elliptical cylinder. A wall transverse to the axis of the tubular surface 32 surrounds the aperture 20 and defines an internal shoulder 34 (see FIG. 5). At the second end of the tubular surface 32 is an outwardly protruding stop 36. The stop 36 has a partially cylindrical surface 38 preferably co-axial with the axis of tubular surface 32 and capable of contacting a first end of the worm 16 (See FIG. 5).

The worm 16 is disposed within the tubular surface 32 such that the worm shaft 18 protrudes from the aperture 20. A frustoconical section intermediate to the ends of the worm shaft 18 and having a surface transverse, and preferably perpendicular, to the axis of the worm shaft 18 defines a worm shaft shoulder 40. When the worm shaft 18 is placed through the aperture 20, the worm shaft shoulder 40 and the internal shoulder 34 cooperate to prevent the outward axial motion of the worm 16.

Preferably, a bushing 42 is placed between the shaft shoulder 40 and the internal shoulder 34. The bushing 42 substantially prevents the movement of air and water along the worm shaft 18 and through the aperture 20 in the cover 12. The bushing 42 is preferably made of a resilient material, such as plastic.

The arm 22 is rotatably mounted to the central post 28, with the central post 28 extending through a circular aperture 44 in the arm 22. Preferably, a tubular bearing 46 is disposed between the cover 12 and the arm 22 along the central post 28. Most preferably, the bearing 46 is placed in an interference fit with the cover 12, centering on a raised surface 47 protruding from the cover 12.

Preferably, the arm 22 has a first elongated end which is attachable to the sash 26 and a partially circular second end 48 in which is formed an integral worm gear 50. The worm gear 50 meshes with the worm 16, whereby rotation of the worm 16 causes the arm 22 to rotatably pivot about the central post 28. Alternatively, a separate worm gear may be disposed on the central post 28 and secured to the arm 22 such that rotation of the worm 16, in mesh with the separate worm gear, causes the arm 22 to pivot about the central post 28.

Figure 3:
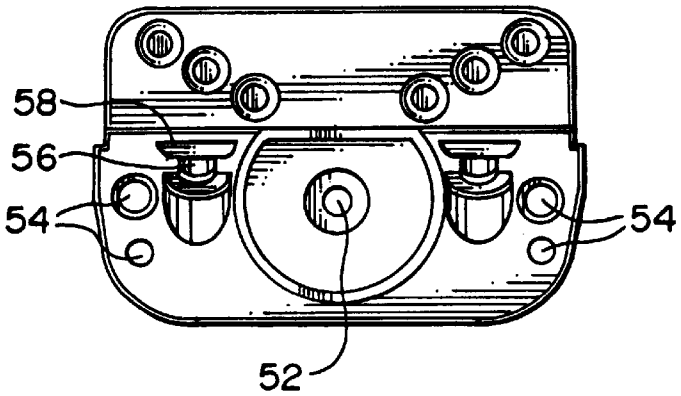
FIG. 3 is a plan view of a base of the present invention.
Figure 4:
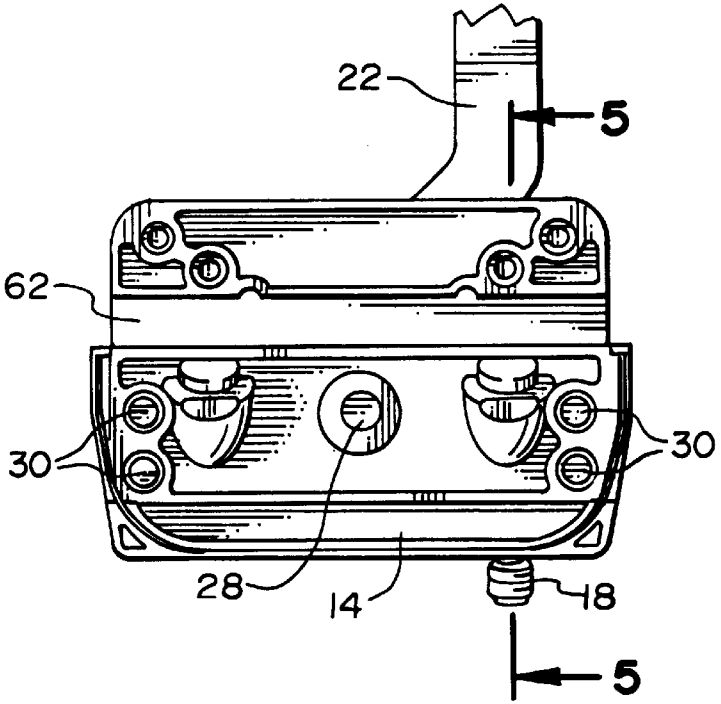
FIG. 4 is a bottom plan view of an assembled operator according to the present invention with the arm partially shown.

The base 14, also preferably of die cast zinc manufacture, has a central circular aperture 52 and four circular fastener post apertures 54 (see FIGS. 3, 4, and 5). The central aperture 52 and the fastener post apertures 54 correspond spatially with the central post 28 and the fastener posts 30, respectively.

The base 14 has an angled tubular worm support surface 56 and a depressed trapezoidally-shaped stop support surface 58. The worm support surface 56 mates with the tubular surface 32 and the stop surface 38 to define an enclosure 60 therebetween in which the worm 16 is disposed. Together, the worm support surface 56, the internal shoulder 34, the worm shoulder 40, the tubular support surface 32 and the stop surface 38 substantially prevent the axial and transverse motion of the worm 16.

The stop support surface 58 defines a depression in which the stop 36 is seated. The stop support surface 58 substantially prevents the movement of the stop 36 along the interior surface of the base 14 when the base 14 is secured to the cover 12.

Figure 7:
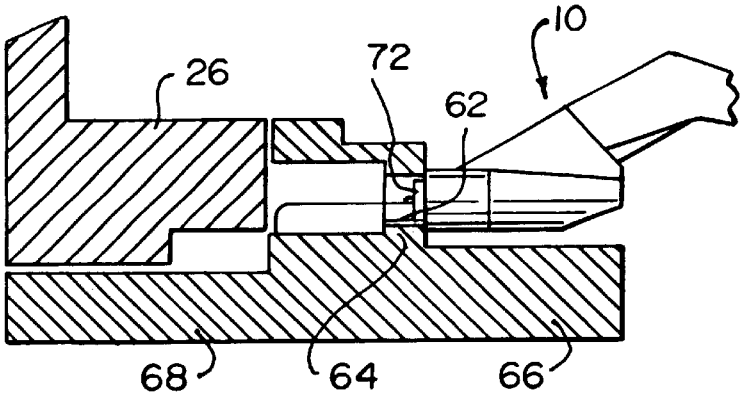
FIG. 7 is cross-sectional view of a window showing an exemplary embodiment of the present invention installed therein with the arm and part of the handle removed.
Figure 8:
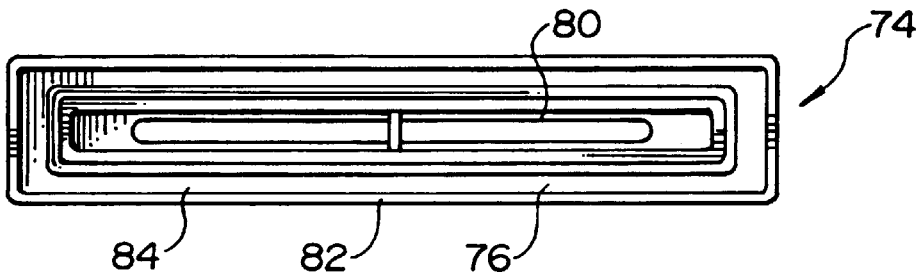
FIG. 8 is a plan view of an exemplary embodiment of a window operator gasket fitting tool for use with an exemplary embodiment of the present invention.
Figure 9:
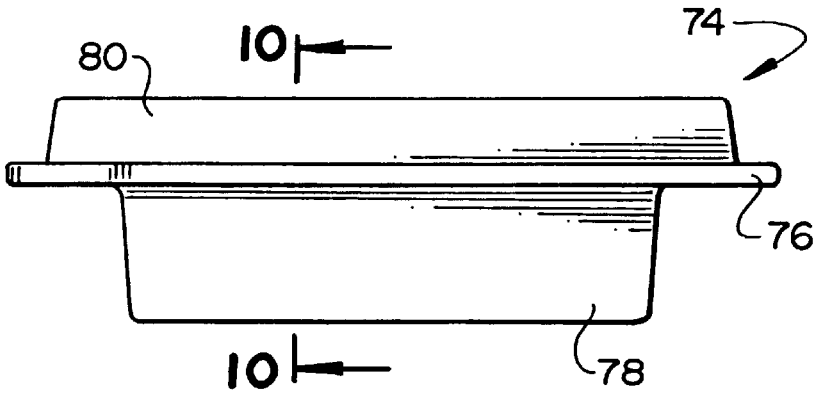
FIG. 9 is a side view of the window operator gasket fitting tool.
Figure 10:
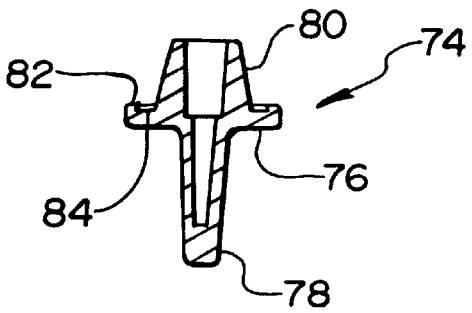
FIG. 10 is a cross-sectional view of the window operator gasket fitting tool taken along line 10—10 in FIG. 9.

On the bottom side of the base 14 is formed a slot 62 of rectangular cross-section which extends from one side of the base 14 to the other. As shown in FIG. 7, a raised wall 64 of rectangular cross-section extending along a sill 66 of a frame 68 fits substantially within the slot 62 when the operator 10 is secured to the frame 68. The wall 64 prevents the unobstructed flow of air and water along the bottom of the base 14 between the base 14 and the sill 66.

Additionally, a gasket 70 may be placed around an opening in the sill 66 to ensure that a sealing surface is provided around the operator 10. When the operator 10 is secured to the sill 66, the gasket 70 fits around a rearwardly facing edge 72 protruding from a rearwardly facing surface of the cover 12 and the base 14. The gasket 70 ensures that a water and airtight sealing condition is maintained between the operator 10 and the sill 66.

To ensure proper placement of the gasket 70, a special window operator gasket fitting tool is used, shown generally as 74 in FIGS. 8–11. The tool 74 includes a support surface 76, a handle 78, and a raised central portion 80. The support surface 76 has a raised outer edge 82, defining a groove 84 between the outer edge 82 and the central portion 80.

Figure 11:
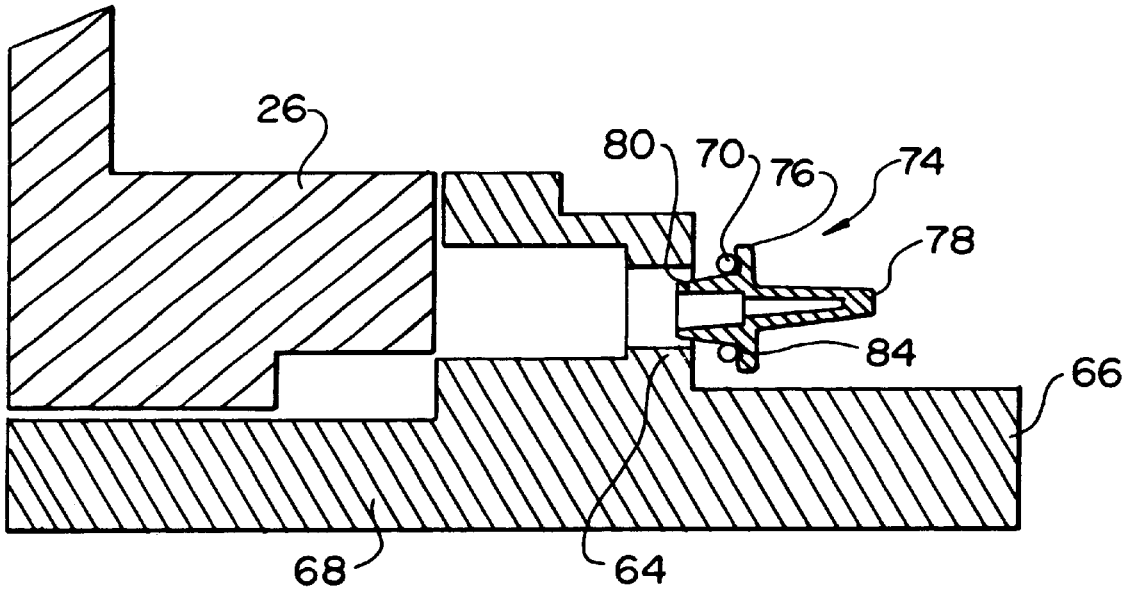
FIG. 11 is cross-sectional view of a window and a window operator gasket fitting tool showing the window operator gasket fitting tool in an intermediate position relative to an opening in a sill of the window.
Figure 12:
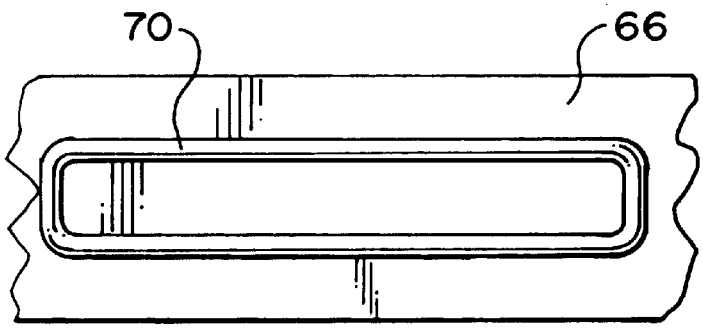
FIG. 12. is a partial elevation view showing a gasket fitted around an opening in a window sill.

During installation, the gasket 70, preferably made of polyethylene foam with an adhesive backing, is placed on the fitting tool 74 so that the gasket 70 seats within the groove 84 (see FIG. 11). The fitting tool 74 is then placed within the opening in the sill 66. In doing so, the gasket 70 will be placed in the proper position for use with the operator 10 (see FIG. 12). Use of the tool 74 eliminates the need to apply the gasket 74 directly to the operator 10, which might cause some alignment difficulties.

Preferably, the operator is assembled as follows. The bushing 42 is placed on the worm shaft 18. The worm 16, thus assembled, is disposed within the tubular surface 32 with the worm shaft 18 extending through the aperture 20 and the first end of the worm 16 seated on the stop surface 38. The bearing 46 is then placed on the central post 28, followed by the arm 22. The arm 22 is positioned with the end 48 meshing with the worm 16 so that the arm 22 will lie parallel to the rear of the operator 10 in a first position, and perpendicular to the rear of the operator 10 in a second position when the worm 16 rotated. Finally, the base 14 is positioned with the central post 28 and fastener posts 30 protruding through the central aperture 52 and the fastener post apertures 54.

The posts 28, 30 are then formed and staked to fasten the cover 12 to the base 14. To eliminate warpage of the parts in the operator 10, the central post 28 is secured first using a radial forming method. In performing this radial forming method, a radial riveter is preferably used, having a forming tool designed to create a flat surface on the center post 28. Through control of the time and force parameters, the axial play in the assembled arm 22 can be greatly reduced, preferably to less than a 0.005 inch gap between components.

The specific settings for the time and force parameters will need to be adjusted depending on the characteristics of the cover 12, the base 14, the center post 28, the arm 22 and the associated bearing 46. For example, the parameters will necessarily vary with the arm thickness and the amount of interference between the bearing 46 and the surface of the base 14 designed to receive the bearing 46. However, it has been found that preferably the time required to perform the radial forming method varies between 1 and 2.5 seconds, and that the force behind the forming tool varies between 1200 and 2400 pounds.

After the central post 28 is formed, the fastener posts 30 are preferably staked simultaneously, although alternatively the posts may be staked in a number of different sequences, including individually, for example. In particular, during the staking process, the operator 10 is held stationary while four flat-faced punches are used to simultaneously impart a significant force to the four fastener posts 30. The force imparted to the fastener posts 30 causes the post material to extrude outwardly, thereby securely fasting the corners of the cover 12 to the base 14.

This operator 10 has a number of advantages. The use of mating surfaces on the cover 12 and the base 14 to support the worm 16 and the arm 22 allows for the straight die cast manufacture of the cover 12 and the base 14 without use of paddles and cores. Additionally, by using mating surfaces on the cover 12 and the base 14 to directly support the worm 16, the number of pieces required for assembly of the operator 10 can be reduced. Moreover, the use of mating surfaces on the cover 12 and the base 14 to secure the arm 22 allows for greater range of tolerances and processes to be used to manufacture the arm 22 and associated gear.

Additionally, the elimination of the retainer bearing allows for the placement of the bushing 42, substantially limiting the flow of air and water through the enclosure 60, along the worm shaft 18 and out of the operator 10. Moreover, the slot 62 and corresponding raised wall 64 on the sill 66 cooperate to prevent air and water infiltration along the operator/sill interface in a highly effective fashion.

Furthermore, by spinning down the central post 28 first, and then staking down the fastener posts 30, warpage of the parts and loss of fit will be reduced or eliminated.

Still other aspects, objects and advantages of the present invention can be obtained from a study of the specification, the drawings and the appended claims.

What is claimed is:

1. An operator for controlling the movement of a window sash relative to a window frame between open and closed positions, said operator comprising:

a base having a bottom surface capable of being supported by and attached to a window frame and having an upper surface with at least one depressed section;

a cover wherein front and side portions of said cover contact a portion of the periphery of said base along a base mating shoulder which is formed in the cover and mates with the upper surface of said base to support said cover on said base and define an inner cavity between said cover and said base for housing a worm and a worm engaging arm, said cover having an angled tubular member mated with said depressed section of said base to form a worm enclosure with said depressed section of said base, said cover having a protruding stop at the back end of the worm enclosure and a wall defining a wall aperture, which wall aperture is completely within said cover at the front end of the worm enclosure;

a worm engaging arm pivotally secured between said base and said cover and capable of being attached to a sash to control the movement of a sash between open and closed positions;

a separate bushing defining a bushing aperture for a worm shaft said bushing being larger than said wall aperture and adjacent said wall and within the inner cavity so that said wall retains said bushing; and a worm drivably engaging said arm and having a worm shaft and a worm shoulder disposed on the worm shaft, said worm being positioned in said worm enclosure with one end being retained by said stop and the other end being retained by said bushing, said worm shaft protruding through said bushing aperture and said wall aperture;

said worm enclosure, stop and bushing maintaining axial and transverse positioning of said worm;

the back end of said cover being spaced apart from said base by said protruding stop being in contact with said upper surface.

2. The operator according to claim 1, wherein the worm cavity is a frustoconical shape.

3. The operator set forth in claim 2, wherein the cover includes a central post and the base defines a central aperture with the central post protruding into the central aperture and with said pivotally secured arm being secured between said base and said cover by said post.

4. The operator according to claim 3, further comprising fastener posts extending from said cover, said base including fastener post apertures spatially aligned with said fastener posts, said fastener posts protruding from the fastener post apertures.

5. The operator according to claim 4, further comprising fastener posts extending from said cover, said base including fastener post apertures spatially aligned with said fastener posts, said fastener posts protruding from the fastener post apertures.

6. The operator set forth in claim 1, wherein the cover includes a central post and the base defines a central aperture with the central post protruding into the central aperture and with said pivotally secured arm being secured between said base and said cover by said post.

7. The operator according to claim 6, further comprising fastener posts extending from said cover, said base including fastener post apertures spatially aligned with said fastener posts, said fastener posts protruding from the fastener post apertures.

8. The operator set forth in claim 1, wherein the inner surface of said cover defines a circumferential support surface and wherein said upper surface of said base is configured to fit within said cover to be supported by said support surface and said post.

9. A window operator for attachment to a window having a raised portion comprising:

a base said base being defined as a single piece having an interior support surface, a plurality of fastener post apertures and a bottom exterior surface with a slot therein, wherein said slot is formed within said bottom exterior surface of said base continuously from a first edge of said base to a second edge of said base so as to be capable of engaging a raised portion of a window to provide a means for allowing attachment of the operator to a window and to prevent substantial infiltration of air and water through the operator when said base is attached to a window;

a depressed stop support surface defined within said base;

a cover having a plurality of fastener posts, and an interlocking lip for receiving said base;

an arm pivotally secured to said base; and a worm disposed within the interior support surface and drivably engaging said arm wherein said arm is capable of being adapted to a sash for movement between open and closed positions, wherein said depressed stop support surface prevents axial and transverse motion of said worm.

* * * * *